United States Patent [19]

Horton

[11] 4,356,708

[45] Nov. 2, 1982

[54] MARINE REFRIGERATION SYSTEM

[76] Inventor: Cleaveland F. Horton, 198 Dover Point Rd., Dover, N.H. 03820

[21] Appl. No.: 235,439

[22] Filed: Feb. 19, 1981

[51] Int. Cl.[3] ..... F25D 11/00

[52] U.S. Cl. ..... 62/430; 62/449; 62/457

[58] Field of Search ..... 62/448, 449, 452, 453, 62/430, 394, 457, 518, 438

[56] References Cited

U.S. PATENT DOCUMENTS

| | | | |
|---|---|---|---|
| 2,007,288 | 7/1935 | Thomson | 62/430 X |
| 2,071,183 | 2/1937 | Steenstrup . | |
| 2,127,732 | 8/1938 | Heitman | 62/394 X |
| 2,596,037 | 5/1952 | Maniscalco | 62/449 |
| 2,612,762 | 10/1952 | Minghetti | 62/394 X |
| 2,671,603 | 3/1954 | Bauer . | |
| 3,379,241 | 4/1968 | Gau | 165/53 |
| 3,464,228 | 9/1969 | Hitchcock | 62/448 X |
| 3,605,421 | 9/1971 | Patrick | 62/394 X |
| 3,708,997 | 1/1973 | McLaughlin | 62/449 |
| 3,850,006 | 11/1974 | Redfern et al. | 62/438 X |
| 4,249,923 | 2/1981 | Walda | 62/394 |
| 4,272,968 | 6/1981 | Harvill | 62/448 X |

*Primary Examiner*—Lloyd L. King

*Attorney, Agent, or Firm*—Kenway & Jenney

[57] ABSTRACT

A refrigeration system particularly adapted for use on boats feature a holding plate in the form of a small tank with a removable lid. A set of flanges are formed integrally with the cover, preferably of heavy cast aluminum, and project into the interior of the tank. A cooling coil that carries a standard refrigeration fluid is wrapped around a convexly curved outer surface of the flanges in a manner that maximizes the contact between the coil and the flanges. The tank is preferably filled with a liquid that surrounds the coil and serves as a cold reservoir. The tank is also preferably located within an insulating cabinet and is spaced from the walls of the cabinet to create a zone for conventional refrigeration.

7 Claims, 4 Drawing Figures

MARINE REFRIGERATION SYSTEM

BACKGROUND OF THE INVENTION

This invention relates in general to refrigeration systems and in particular to a holding plate for a marine refrigeration system.

In a standard refrigeration system a refrigeration fluid such as freon is recirculated through a compressor, condenser and evaporator. The fluid is liquified in the condenser and vaporized in the evaporator coils by heat absorbed from a cooling compartment, usually the interior of a refrigerator. Standard systems also typically include some arrangement for filtering and drying the fluid as well as valves to control the movement of the fluid. In most standard refrigerators, the evaporator is a rectangular, flat unit formed from sheet metal with the fluid flowing through the evaporator in channels stamped in the metal. The fluid can be guided either in the channels themselves or in a tube held within the channel.

Marine refrigerators designed for use on comparatively small watercraft must meet design criteria not present in standard household refrigerators. First, a marine unit usually does not have a continuous power supply. Rather, the system can cool only when the main boat engines are operating. It is impractical to run the engines continuously only to provide refrigeration and it is inconvenient, although less costly, to run the engines at regular intervals throughout the day. Due to the limited space available on most boats, a marine refrigerator must also be compact. Another important consideration is that the refrigerator be able to make ice quickly while at the same time having a good cold storage capacity to maintain perishable foods cooled during extended periods where there is no power.

One marine refrigeration unit presently available uses a freezing compartment oriented vertically along the side of a cooling compartment that includes an evaporator. If a liquid is used in the cooling compartment to transmit heat, the side mounting avoids the insulating effect of an air bubble which can form at the top of the liquid. This unit is located in an insulating compartment. To make ice, a plastic divider is lowered into the freezing compartment when it is filled with water.

Another unit is essentially a small household refrigerator. As such it is not especially well suited to marine use except that it is compact. One difficulty is that the cooling is directed generally uniformly into the entire cooling compartment. As a result, the entire refrigerator must be cooled substantially before ice can be made. This ice making process is slow. The unit also has only conventional capabilities for storing coldness. Some factors influencing the storage capacity are the insulating quality of the compartment, the frequency of use of the unit, the nature and quantity of items stored in the refrigerator, and the ambient air temperature. In practice, both of these units will not make ice quickly and require operation of the engines for either an extended period of time or on at least several occasions each day. Another difficulty with the "vertically oriented" refrigeration unit described above is that it is frequently difficult to remove ice cubes from the compartment once they are formed.

It is therefore a principal object of this invention to provide a refrigeration unit that has a short running cycle and a fast freezing capability.

Another object of the invention is to provide such a refrigeration system that is compact and has a good cold storage capacity.

A further object of this invention is to provide a refrigeration system with the foregoing advantages that also creates two temperature zones, one suitable for fast freezing and one suitable for ordinary refrigeration.

A further object is to provide a refrigeration system with the foregoing advantages that has a simplified construction and a competitive cost of manufacture.

SUMMARY OF THE INVENTION

A refrigeration system according to this invention features a holding plate including a tank that surrounds an evaporator coil carrying refrigeration fluid. One wall of the tank, preferably a removable lid, supports a structure for mounting the cooling coil. The support structure is preferably in the form of an opposed pair of flanges that project downwardly from the inner surface of the lid into the tank. Each flange has a curved cross section designed to maximize the contact area between the coils and the support flanges. The flanges and the lid are preferably cast as an integral unit from aluminum. In addition the lid and flanges have a comparatively large wall thickness to promote the efficient transfer of heat from the lid to the cooling coils.

Alternative forms of this invention can utilize other support structures, both solid and hollow, having convexly curved outer surfaces that can be cylindrical, oval, or more complex shapes. Also, it is possible to form the support structure integrally with a non-removable wall of the tank such as its bottom. This wall then defines a fast freeze zone of the system.

In the preferred form the tank holds a liquid such as glycol alcohol and water which promotes heat transfer from the cooling coils to the tank and acts as a cold reservoir to provide cooling over an extended period of time with only a relatively short running cycle. The liquid is preferably formulated to freeze at low temperatures and form an ice slush. The latent heat required to change the ice slush to a pure liquid state greatly increases the cold storage capacity of the system. Also, the tank is preferably located in and spaced from a surrounding insulating cabinet.

These and other features and objects of this invention will be more fully understood from the following detailed description of the preferred embodiments which should be read in light of the accompanying drawings.

DETAILED DESCRIPTION OF THE PREFERRED EMBODIMENTS

Figure 1:
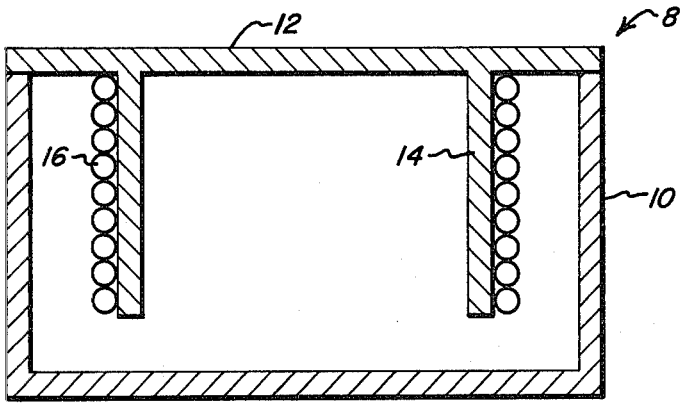
FIG. 1 is a view in vertical section of a holding plate according to the present invention.

FIG. 1 shows "a holding plate" 8 for a compact, two zone refrigeration system particularly adapted for use on boats or campers where there is only an intermittent power supply to generate cooling, but where there is a need for both conventional refrigeration of perishable foods and the rapid freezing of other items such as ice cubes. The holdling plate 8 consists of a tank 10 with a removable cover 12, a pair of flanges 14, 14 that are formed integrally with the cover and project generally downwardly into the tank, and a cooling coil 16 wrapped around and supported by the flanges 14, 14. The coil 16 carries a conventional refrigeration fluid such as freon which is in a cooled, usually liquified state as it enters the coil 16. As it flows through the coil, it absorbs heat thereby cooling the materials in thermal communication with the coil.

Figure 4:
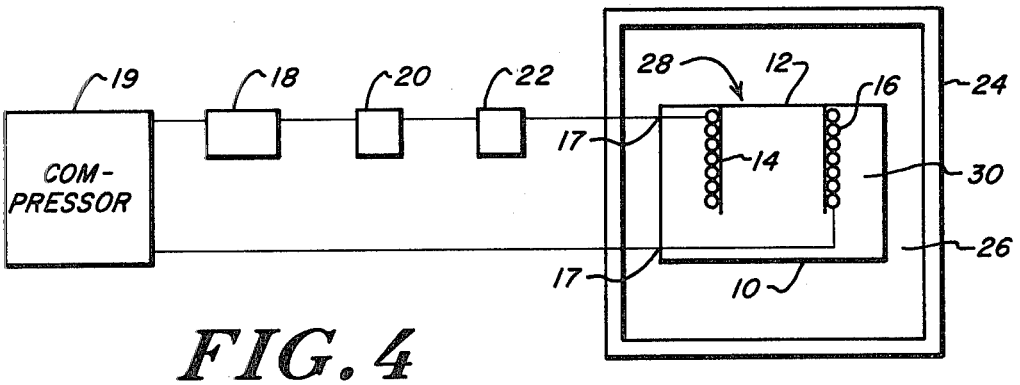
FIG. 4 is a schematic view of a complete refrigeration system according to the present invention utilizing the holding plate shown in FIG. 1 as the cooling unit of a refrigerator defined by a surrounding insulating cabinet.

FIG. 4 shows a simple refrigeration system utilizing the holdling plate 8. The coil 16, which can be standard copper tubing, penetrates the tank through bulkhead fittings (not shown) at 17, 17. The downstream end of the coil carries warmed or vaporized gas to a compressor 19 powered by an on-board engine (not shown). The compressed gas is then directed to a condenser 18 which acts as a heat exchanger to cool and liquify the fluid. The fluid passes through a filter and dryer 20, typically a quantity of silica gel, and then a standard expansion valve 22 which meters the flow of the compressed, cooled liquid refrigerant to the evaporator coil in response to conditions at its outlet side. The holding plate is enclosed in an insulating cabinet 24 which defines the cooling region of the system. The cabinet may simply be a box-like structure of styrofoam or some other conventional insulating material. The holdling plate is spaced on all sides from the cabinet 24 (except for supports, not shown) to reduce unwanted heat transfer and to define a region between the cabinet 24 and the holdling plate for storing perishable foods in a cooled environment like that of a conventional household refrigerator. This region, generally denoted by the reference numeral 26, is a "cool" temperature zone. As will be discussed in more detail below, the cover 12 is cooled more efficiently and more quickly than the zone 26, and therefore its upper surface defines a "fast freeze" zone 28.

Figure 2:
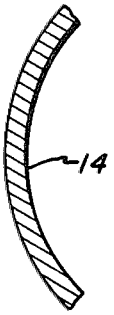
FIG. 2 is a view in horizontal section of one of the support flanges shown in FIG. 1.

A principal feature of the present invention is the construction of the holdling plate and in particular the placement of the cooling coil 16 on a support structure, the flanges 14, 14, that is integral with the lid 12 of the tank 10. This construction is intended to facilitate the rapid and efficient transfer of heat from the lid to the fluid carried in the coils 16. The integral construction, preferably with the flanges 14, 14 and the lid 12 cast together as a single structure, is beneficial to this transfer and to the creation of the "fast freeze" zone 28. Also important are the material forming the cover and flanges, their dimensions, and the configuration of the flanges. The material is preferably aluminum. Other structural materials having good thermal conductivities may be suitable, but at least one plausible material, stainless steel, has been found to yield significantly inferior conductivity results. As to dimensions, the cover and flanges should be significantly thick so as to provide an efficient path for the transfer of thermal energy to the coils 16. For example, a convenient, compact size for the tank 10 for use on a boat is 6 inches by 9 inches by 14 inches. For a unit with these dimensions, a cover and flanges having an average thickness of approximately $\frac{3}{8}$ inch has been found to be adequate. The configuration of the flanges is important to ensure a good mechanical and thermal contact between the coil 16 and the flanges. In the preferred form shown, each flange has a cross section (FIG. 2) that is generally a portion of the circumference of a circle with the concave sides of the flanges facing one another.

The configuration of the outer surface of flanges 14, 14 is more significant than that of the inner surface. The outer surface should be convex to place the outer surface of the flanges in substantially continuous contact with the coil 16. Of course, even using the configuration shown in the drawings, the coil 16 should be wrapped tightly around the flanges. While they are not necessary (nor shown), clips, brackets or other mechanical devices can be used to secure the coil against the flanges and urge them towards one another.

Figure 3:
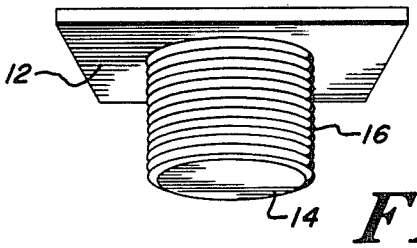
FIG. 3 is a perspective view of an alternative support structure formed integrally with the tank lid and carrying a cooling coil on its outer surface.

While the preferred form of the invention utilizes two mirror-image flanges to support the coil 16 in a good heat transferring relationship, this support function can be performed by a variety of alternative structures. One alternative, shown in FIG. 3, is a solid, generally cylindrical mounting stud 14' which, like the flanges 14, 14, can be formed integrally with the lid 12 and projects into the interior of the tank 10. The outer surface of the cylindrical stud 14' is convex and of a sufficient cross-sectional diameter to support the coil 16 in a tightly wrapped manner. In still other forms, the stud 14' can be a hollow cylindrical shape or its outer surface can be oval or a somewhat more complex curved shape. The flanges 14, 14 are preferred, however, since they utilize less material while nevertheless providing a highly efficient path for the flow of heat from the lid 12 to the coil 16.

While the tank 10 can be filled with air, it is preferably filled with an anti-freeze solution 30 such as glycol alcohol and water. The solution serves two principal functions. First, it facilitates the transfer of thermal energy from the zone 26 to the coil 16. This makes the system a more efficient conventional refrigerator. Second, the solution has a relatively large specific heat and is formulated to freeze at low temperatures to store coldness through the change of state of the solution from a liquid to a solid. The solution therefore has the capacity to act as a cold reservoir. As a result, the system can be operated for a comparatively short period of time each day, but still maintain the desired cool temperature in the zone 26 until the next operating cycle. It should be noted that a layer of air will usually form between the solution and the lower surface of the lid due to the expansion and contraction of the tank and the fluid during temperature changes. An important advantage of the present invention is that the flanges 14, 14 penetrate this air layer and provide an efficient thermal conductivity path through what would otherwise be an insulating region.

This refrigeration is particularly useful on comparatively small boats or in camping vehicles where there is a need for a refrigeration system, but where there is no continuous power supply. With a holdling plate in the preferred form described above and enclosed in an insulating cabinet, applicant has found that a short running cycle of approximately twenty minutes each day is sufficient to make ice rapidly in the zone 28 and maintain a food preserving low temperature in the zone 26 throughout the day. Moreover, it is possible to make additional batches of ice cubes in the zone 28 by running the system for only a few minutes. Besides the advantages of operation on intermittent power, a fast freeze capability and two temperature zones, the system is compact, accommodates conventional ice cube trays (they are simply placed on the lid 12) and there is no unusual difficulty in removing the ice cubes.

While the invention has been described with reference to its preferred embodiments, various modifications are, of course, possible. One such modification is forming the support flanges or other structure integrally with the bottom or other wall of the tank 10. A disadvantage of these arrangements is that ice cube trays cannot be simply placed on the "fast freeze" wall. Another modification is forming the support structure and lid or other "fast freeze" wall as separate elements that are then secured together. Other factors remaining the same, this will usually result in a less efficient heat transfer from the lid and somewhat higher manufacturing costs. These and other modifications and variations will occur to those skilled in the art from the foregoing detailed description and the accompanying drawings. Such modifications and variations are intended to fall within the scope of the claims.

What is claimed is:

1. In a refrigeration system including a compressor that operates intermittently, a condenser, and a cooling coil connected in fluid communication, the improvement comprising a holdling plate that includes a fast freeze zone, said holding plate conducting heat to said cooling coil, said holdling plate including:

a closed tank that surrounds said cooling coil, a support structure for said cooling coil that projects from one wall of said tank into the interior of said tank, said support means (i) having a convexly curved outer surface that mounts said coil with substantially continuous contact therebetween, (ii) being formed integrally with said one wall, (iii) having a sufficient cross-sectional thickness to provide a highly efficient thermal path between the interior of said tank and said one wall to provide said fast freeze at the outer surface of said one wall, and (iv) located within said tank so that said coils are spaced from the walls of said tank, and an anti-freeze liquid held in said tank that acts as a cold reservoir and enhances the flow of thermal energy from the side and bottom walls of said tank to said coil, said liquid typically being spaced from the upper wall of said tank.

2. The evaporator according to claim 1 wherein said one wall is a removable lid.

3. The evaporator according to claim 2 wherein said lid and support support are formed of cast aluminum.

4. The evaporator according to claim 2 or 4 wherein said support structure comprises a pair of opposed flanges.

5. In a refrigeration system including a compressor that operates intermittently, a condenser, and a cooling coil connected in fluid communication, the improvement comprising a holdling plate that includes a fast freeze zone, said holdling plate conducting heat to said cooling coil, said holdling plate including:

a tank that surrounds said cooling coil and has a removable lid, a support structure for said coil formed integrally with said lid from cast aluminum, said support structure projecting generally downwardly into said tank and carrying said coil in a tightly wrapped manner on its convexly curved outer surface, an anti-freeze liquid held in said tank and typically spaced from said lid that enhances the flow of thermal energy from said tank to said coil and acts as a cold reservoir, and an insulating enclosure that surrounds and is generally spaced from said tank to define a cool temperature zone suitable for food storage, said support means and said lid having a sufficient cross-sectional thickness to provide a highly efficient cooling of said lid and provide said fast freeze zone at the outer surface of said lid.

6. The holdling plate according to claim 5 wherein said support structure comprises a pair of opposed flanges.

7. The holdling plate according to claim 5 wherein said evaporation and said insulating enclosure are highly compact.

* * * * *